United States Patent [19]

Goldhammer

[11] 4,436,029

[45] Mar. 13, 1984

[54] DEVICE FOR THE PRESS DOOR OF A BALING PRESS

[76] Inventor: Albert Goldhammer, Zum Hecht 46, D-7770 Überlingen, Fed. Rep. of Germany

[21] Appl. No.: 303,204

[22] Filed: Sep. 18, 1981

Related U.S. Application Data

[63] Continuation of Ser. No. 198,965, Oct. 20, 1980, abandoned.

[30] Foreign Application Priority Data

Oct. 18, 1979 [DE] Fed. Rep. of Germany ..... 2942218
Oct. 18, 1979 [DE] Fed. Rep. of Germany ..... 2942229

[51] Int. Cl.[3] ..... B30B 15/32

[52] U.S. Cl. ..... 100/250; 100/218; 100/255

[58] Field of Search ..... 100/218, 250, 255; 53/527

[56] References Cited

U.S. PATENT DOCUMENTS

| | | | |
|---|---|---|---|
| 1,826,936 | 10/1931 | Jacobson et al. | 100/255 |
| 1,845,117 | 2/1932 | Behle | 100/255 |
| 2,211,198 | 8/1940 | Christoph | 100/255 |
| 3,099,205 | 7/1963 | Lovrinch | 100/255 |
| 3,708,953 | 1/1973 | Aluotto | 100/250 X |

FOREIGN PATENT DOCUMENTS

| | | | |
|---|---|---|---|
| 860897 | 12/1952 | Fed. Rep. of Germany . | |
| 905107 | 2/1954 | Fed. Rep. of Germany . | |
| 1981697 | 3/1968 | Fed. Rep. of Germany . | |
| 2022069 | 11/1970 | Fed. Rep. of Germany . | |
| 571106 | 5/1924 | France | 100/250 |
| 850591 | 10/1960 | United Kingdom . | |
| 1041830 | 9/1966 | United Kingdom . | |
| 1095626 | 12/1967 | United Kingdom . | |
| 1176250 | 1/1970 | United Kingdom . | |
| 1270613 | 4/1972 | United Kingdom . | |
| 1338880 | 11/1973 | United Kingdom . | |
| 2009668 | 6/1979 | United Kingdom . | |

*Primary Examiner*—Billy J. Wilhite
*Attorney, Agent, or Firm*—Larry J. Palguta; John A. Young

[57] ABSTRACT

A clampable closure device for the press door (3) of a baling press comprises a lever (5) nonrotatably connected to a shaft (13) the other end of which is fixed to an end of eccentric lever (12). The other end of the eccentric lever (12) is fixed to a shaft (14) mounted on spaced apart bearing members (2) secured to the top of the press housing (1). Beams (6) each have one end rotatably connected to a shaft (13) and the other end of each beam (6) has an angled guide recess (10) receiving a traverse shaft (7) connected to the press door (3). Rotation of the lever (5) effects a clampable closure and locking of the press door (3) to the press housing (1). The device for the press door (3) may be used on conjunction with a filler slide (19) having an angle lever (20). Lever arm (22) effects retraction movement of a closure bolt (24) against the resistance of spring (26) to effect opening of the filler slide (19). The side of the closure bolt (24) engaging the housing (1), is chamfered so that the closure bolt (24) automatically snaps into a catch recess (18) on the press housing (1). The clampable closure device for the press door may be used in conjunction with a bag (35) mounted on the press door (3) and housing (1) to receive an ejected bale (37).

13 Claims, 7 Drawing Figures

DEVICE FOR THE PRESS DOOR OF A BALING PRESS

REFERENCE TO RELATED APPLICATION

This application is a continuation of application Ser. No. 198,965 filed Oct. 20, 1980, now abandoned.

TECHNICAL FIELD

This invention relates to a closure device for the press door of a baling press.

BACKGROUND ART

In baling presses, the press plate operates against the press door which is closed during the pressing procedure. After conclusion of the pressing procedure the press door is opened in order that a finished bale may be removed from the baling press. The opening of the press door meets with difficulties because the press door is under considerable pressure from the continuing pressing pressure and the pressure arising from the finished bale.

DISCLOSURE OF THE INVENTION

The object of the invention is to develop a closure device such that any danger of injury upon opening the press door is obviated. Furthermore the opening of the door is effected easily and with relatively small expenditure of energy. A further object is to allow easy removal of the pressed bale by suitable mounting of the door.

According to the invention, a baling press has a closure device for a vertical press door thereof comprising a hand operated lever pivoted on the press housing and attached by an eccentric to pivotable closure beams the free ends of which are detachably and clampably connected to the press door by a shaft attached to the press door. The press door shaft engages guide openings positioned near the ends of the beams and the guide openings are inclined at an angle to the vertical such that the open ends of the guide openings are closer to the press door than the closed ends of the guide openings.

The press door is tensioned with respect to the press housing by a campable closure device which has the advantage that the press door can be held in the closed position and locked against the press housing to withstand the relatively large pressing pressure.

In order to open the press door, the closure device must firstly be released. The press door cannot be directly opened but must firstly be released from the pressing pressure by releasing the closure device. Danger of injury is excluded because once the press door is released from the pressing pressure, snapping up of the closure device is avoided.

In a preferred embodiment of the present invention, the clampable mounting of the beams is accomplished by the ends of the beams opposite the guide openings being rotatably connected to one end of an eccentric lever via shafts with the other ends of the eccentric lever being nonrotatably connected to a further shaft which is rotatably mounted in bars disposed on the press housing.

An eccentric clamping device is therefore proposed which is operable with a lever and has the advantage that relatively large clamping forces can be produced with relatively small expenditures of energy.

In order to take up a relatively high pressing pressure, two parallel beams disposed spaced apart from one another are provided with an eccentric lever the ends of which are rotationally connected to one another via the above-mentioned shafts. The two beams arranged spaced apart from one another may therefore take up greater pressure and lead to symmetrical loading of the press door.

It is important that the longitudinal axes of the guide openings are at an angle to the vertical and are inclined backwards with respect to the direction of clamping.

So long as the press door is not subjected to a pressing force, the beams may be opened directly, that is, by lifting up the handle so that the guide openings disposed on the free ends of the beams are brought out of engagement with the shaft connected to the press door. This simple operation of the beams results from the fact that they are connected by a common handle.

However, as soon as the press door is subjected to pressing pressure, the drawing up of the lever handle and release of the shaft connected to the press door from the guide openings of the beams is prevented because the guide openings are inclined downwards in the direction of clamping of the closure device. It is thus ensured that the press door when subject to pressure cannot be opened inadvertently and possibly cause injuries due to snapping up of the beams and the handle, or dropping of the press door. This safety device is therefore self securing because opening of the press door is not possible due to the guide openings being inclined backwards.

As soon as the press door is under pressing pressure or under the pressure of the finished bale, the closure device can no longer be released without releasing the eccentric clamping device. It is proposed that in opening the press door there should be a two stage procedure such that first of all for releasing the closure device the lever of the eccentric clamping device is operable and only then is the handle connecting the beams capable of being drawn up.

A further closure device is proposed in conjunction with the filler slide of a baling press. When closed, the filler slide must be secured firmly with the press housing in order to avoid an inadvertent opening of the filler slide during operation of the baling press, that is, during movement of the press slide. It is thus necessary for the closure mechanism to be designed so that upon closing the filler slide, the mechanism automatically produces a power locking connection with the press housing.

During opening of the closure mechanism a resistance in the form of a spring must be overcome.

A preferred embodiment of the invention is characterised in that on the filler slide an angle lever is pivotably mounted one end of which serves for manipulation and the other end of which contacts a spring loaded closure bolt movable in a bore of the filler slide, the closure bolt in the closed state of the filler slide disposed in a catch recess of the press housing.

It is essential that the end of the closure bolt associated with the catch recess, is chamfered or wedge shaped in the closing direction of the filler slide. The closure bolt thereby catches automatically in the catch recess in the press housing when the filler slide drops or slides in the closing direction.

A further subject of the invention is a device for removing and further handling pressed bales from a bale press in which the bale is compressed against a press door pivotably hinged to the bale press and the press door is opened after conclusion of the pressing procedure and the bale removed.

The further object of the invention is to develop a device of the said type such that manipulation of the bale to be pushed out is facilitated and in particular a soiling of the setting up plane of the baling press is avoided and in a simple manner a bag for receiving the ejected bale is attached to the baling press.

With this further object in view the invention is characterised in that the pivot of the press door is arranged under the baling press parallel to the bottom surface of the baling press and that the inner door face of the opened press door forms an inclined plane for the bales.

An essential feature of the invention is that the press door is no longer hinged laterally like a room door on the baling press but is hinged like a trap door at the bottom of the baling press with a pivot parallel to the setting up plane. The advantage is that the inner door face of the opened press door forms an inclined plane for the bales. After completion of the pressing procedure and opening of the press door, the bale is pushed out of the baling press and it moves from the inner bottom face of the baling press onto the inner door face of the forwardly inclined door which thereby serves as a sliding plane for the bales.

As known in the prior art, the bale falls onto the floor where it leaves various soiling particles.

The bale can simply be further transported by positioning receiving devices, for example, a fork stacker connected flush with the door face.

Manual handling of the bale can be omitted. For example, the bales have to be raised by hand in order to be placed onto a pallet or the prongs of a fork stacker. With the press door opening downwards, there is the further advantage that this press door, according to the invention, also forms the holding means for the sack so that the bale can be pushed directly from the press into the sack. Tearing or manual holding of the sack may be omitted because the press door supports and tautly holds the sack.

The sack is firstly pushed onto the opened press door and then attached to the bale press. A further feature of the present invention is that some distance from the press door pivot there is at least one attachment point for a cable pull on the press door and that the other end of the cable pull is connected to an energy storer, for example, a coiled spring or a gas pressure spring which upon opening the press door is clamped and upon closing the press door is released.

In this way any unintensional dropping of the press door is avoided because at this time the energy storer is tensioned and the press door may only open against the force of the energy storer, opening slowly downwards in the direction of the floor. On the other hand, the press door can be raised without special effort because the energy storer is then released and the press door is drawn under the force of the energy storer into its closed position.

In the following specification, the invention is explained in more detail with reference to the drawings illustrating one method of construction.

BRIEF DESCRIPTION OF THE DRAWINGS

The invention will be described with reference to the accompanying drawings.

BEST MODE FOR CARRYING OUT THE INVENTION

Figure 1:
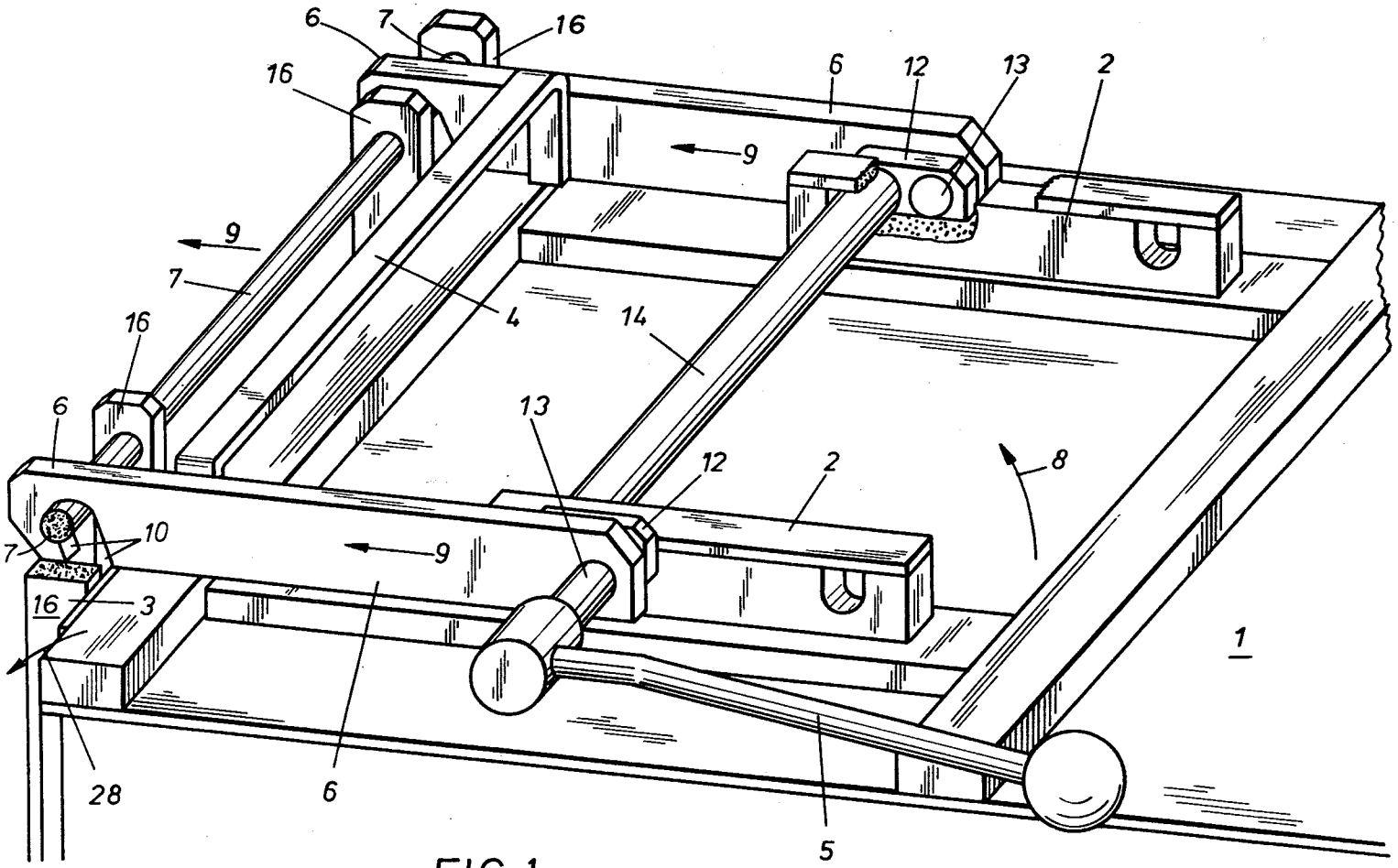
FIG. 1 shows a perspective plan view of the closure device of the press door with partial cut-aways illustrating the eccentric connection and a guide opening.

Referring now to FIGS. 1–3 and 5, press door 3 is pivotably mounted on a press housing 1. The pivot bearings of the press door 3 are not shown in FIG. 1; the press door 3 is to be opened in the direction of the arrow 28 in which the pivot bearing of the press door is arranged below and parallel to the setting up plane of the press door on the press housing 1. Traverses 16 are fixed to the press door 3 and through which pass a shaft 7. In FIG. 1 the front traverse 16 and the shaft 7 are shown partly broken away in order to explain the operation of the closure device. Bearing members 2 are spaced apart from one another on the press housing 1 and form bearings for a shaft 14, each end of which is connected to an eccentric lever 12. The other end of each eccentric lever 12 is connected and rotationally fixed to an axle 13 on which is mounted a lever 5 for operating the clamping device.

In FIG. 1 the right hand member 2 on the press housing 1 is shown partly broken away in order to show the bearing of the shaft 14 and the shaft 13 on the eccentric lever 12.

Figure 2:
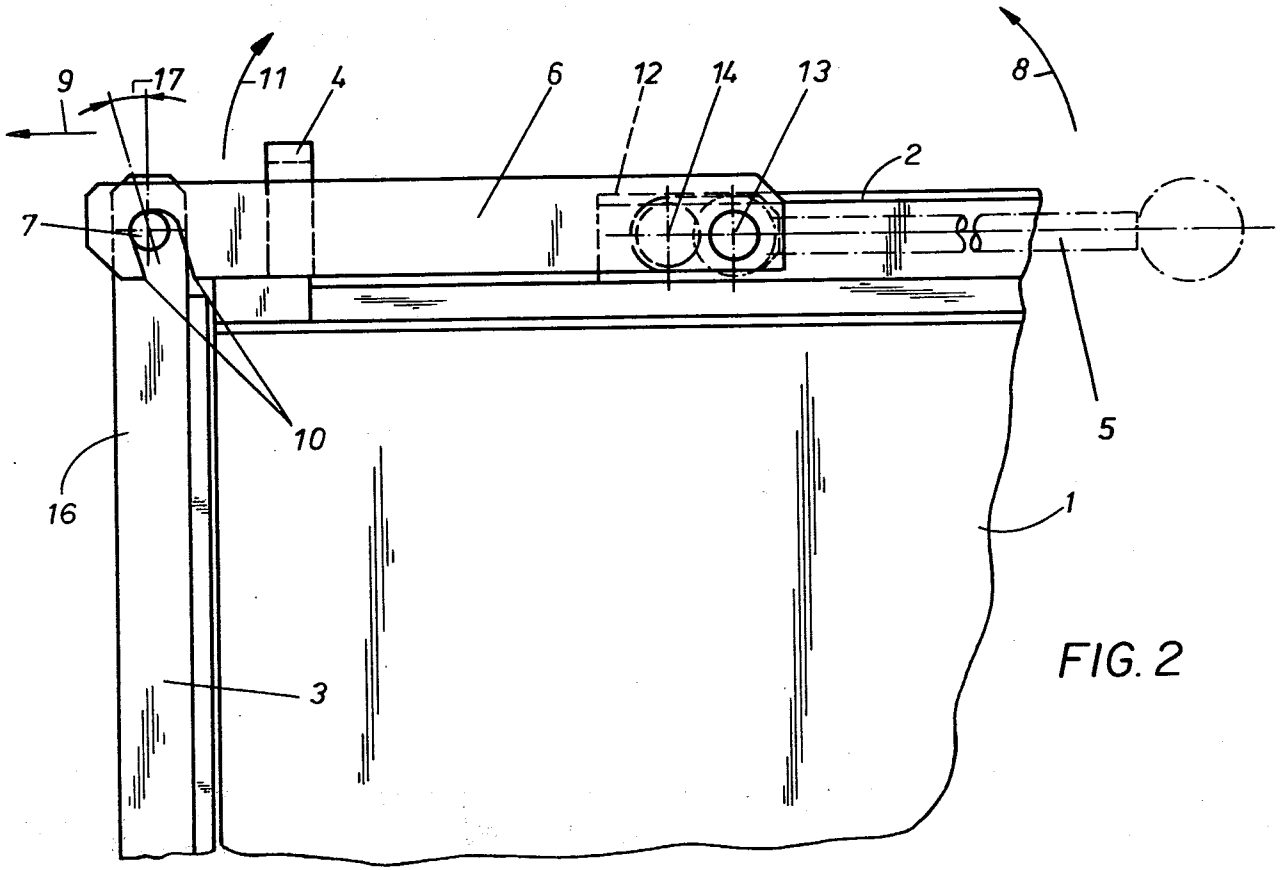
FIG. 2 shows a side view of the closure device according to FIG. 1 in the clamped position.
Figure 3:
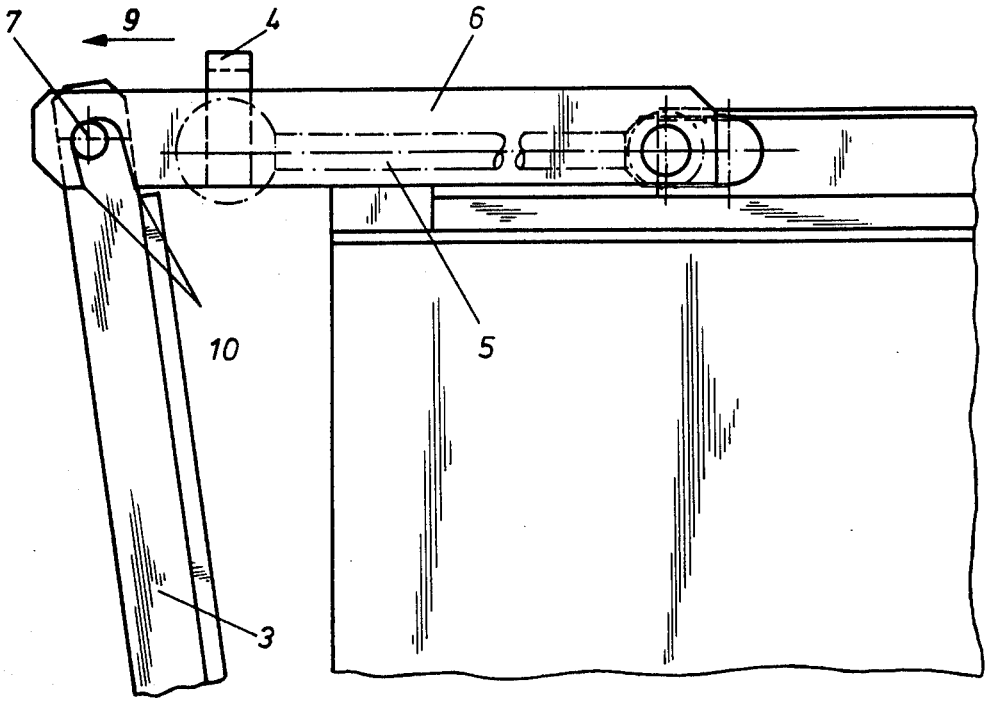
FIG. 3 shows a side view of the closure device in the released position.

If the lever 5 is moved upwards in the direction of the arrow 8 then the eccentric clamping device is released as shown in FIG. 3. As the beams 6 are rotatable on the shafts 13 connected eccentrically relative to the shaft 14, the beams 6 are pushed forwards in the direction of the arrow 9 by operation of the lever 5 rotated in the direction of the arrow 8 so that the press door 3 passes from the closed position shown in FIG. 2 to the partly opened position shown in FIG. 3.

Now by lifting handle 4 which connects the two beams 6, the guide recesses 10 disposed in the free ends of the beams 6 can be brought out of engagement with the shaft 7 on the press door 3.

It can be seen from FIG. 2 that the longitudinal axis of each guide opening 10 is at an angle 17 in relation to the vertical and is inclined in a direction opposite to the direction of clamping which is opposite the direction of arrow 9. From this it can be seen that the press door 3 in the clamped position of the closure device shown in FIGS. 1 and 2, is closed and is not pretensioned from inside by a pressure in the direction of the arrow 9.

At that time, the eccentric closure device is not released. However, as soon as the press door 3 is subjected to a pressing pressure in the direction of the arrow 9, the closure device (beams 6 with guide recesses 10 in engagement with the shaft 7) is fixed so that the lever 4 is no longer capable of being drawn up in the direction of the arrow 11.

Then according to FIG. 3, first of all the eccentric clamp device must be released in order to draw up the handle 4 in the direction of the arrow 11. The previously described self securing property of the closure device is accomplished because operation is impelled first of all to operate the levers in the direction of the arrow 8 in order to be able then to operate the handle 4 in the direction of the arrow 11.

Figure 4:
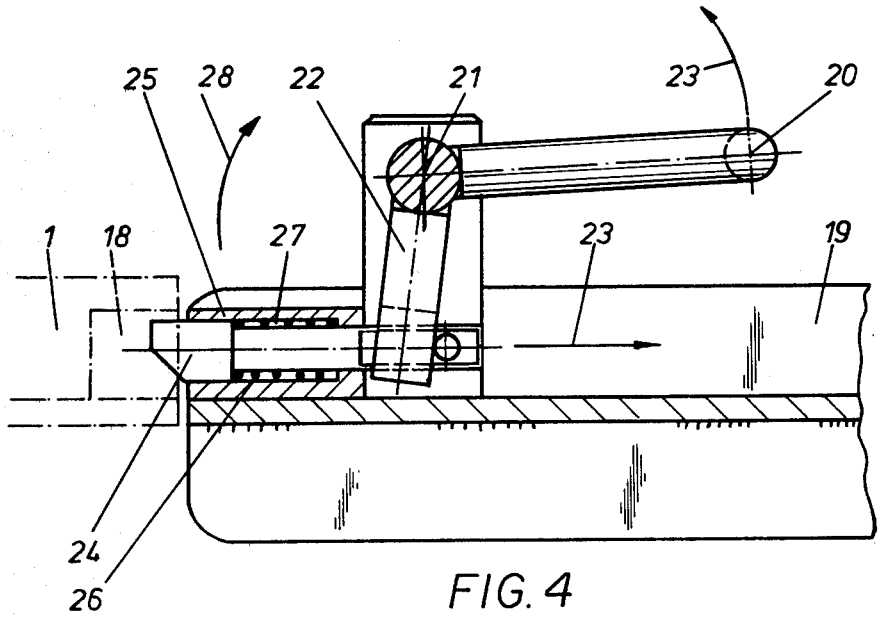
FIG. 4 shows a section view of the closure mechanism of the filler slide of a baling housing.

The representation in FIG. 4 refers to the securing of a filler slide 19 on the press housing 1. The filler slide 19 is to be opened in the direction of the arrow 28, the pivot bearings of the filler slide 19 on the press housing 1 not being shown. FIG. 4 shows the filler slide 19 in its closing position on the press housing 1.

On a traverse on the filler slide 19, there is pivotably mounted on a shaft 21 an angle lever consisting of the lever 20 and the lever arm 22.

The lever 20 operates the closure device while the free end of the lever arm 22 contacts a closure bolt 24 movably mounted under the force of a spring 26 in a bore 27 of the filler slide 19. The bore 27 may be formed in a box 25 of the filler slide 19; it is preferred to provide two closure mechanisms acting in parallel on the filler slide 19, the levers 20 of which are then connected to one another by means of a handle connecting the common levers 20.

Figure 6:
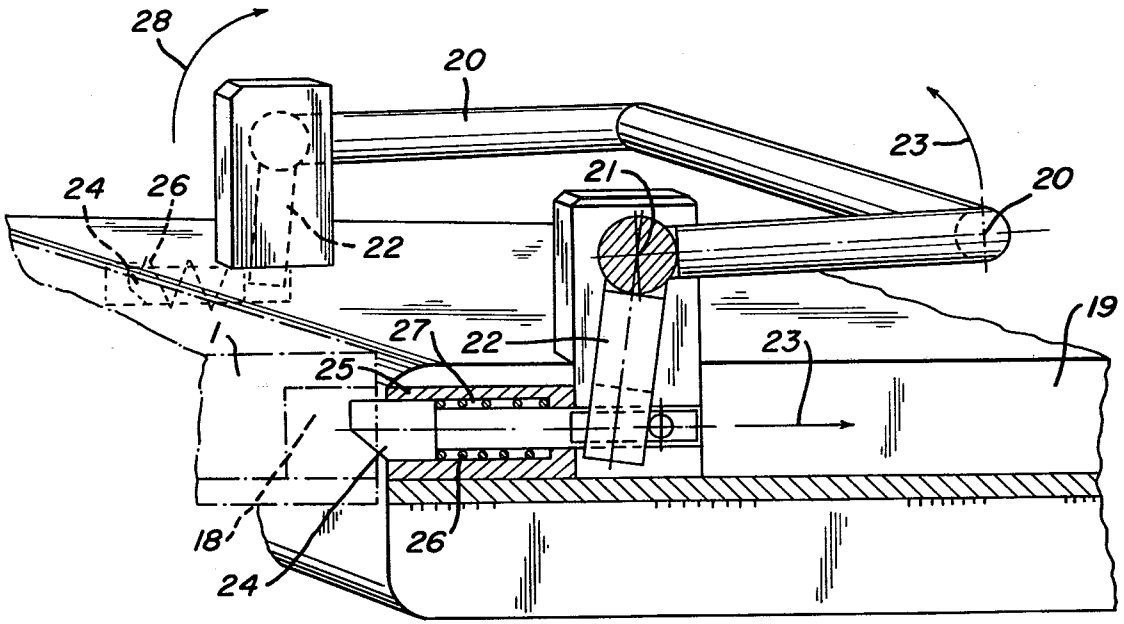
FIG. 6 shows, partly in section, a perspective view of the embodiment of FIG. 4 with a double closure mechanism.

This double closure mechanism is shown in FIG. 6 which in all other respects is identical with FIG. 4 and wherein the same reference numerals are used for the same parts illustrated in FIG. 4.

If the lever 20 is drawn upwards in the direction of the arrow 23, then the lower arm 22 pivots in the direction of the arrow 23 so that the closure bolt 24 is brought out of engagement with the catch recess 18 in the press housing 1.

According to the invention, the front end of the closure bolt 24 in the closing direction (opposite direction to the arrow 28) of the filler slide 19, is chamfered so that upon closing the filler slide 19 the closure bolt 24 automatically snaps into the catch recess 18 on the press housing 1.

The invention relating to the device for the removal and further handling of pressed bales from a baling process is explained more precisely in the drawing with reference to only one method of construction.

There follows from the drawings and the description that further features and advantages are present.

Figure 5:
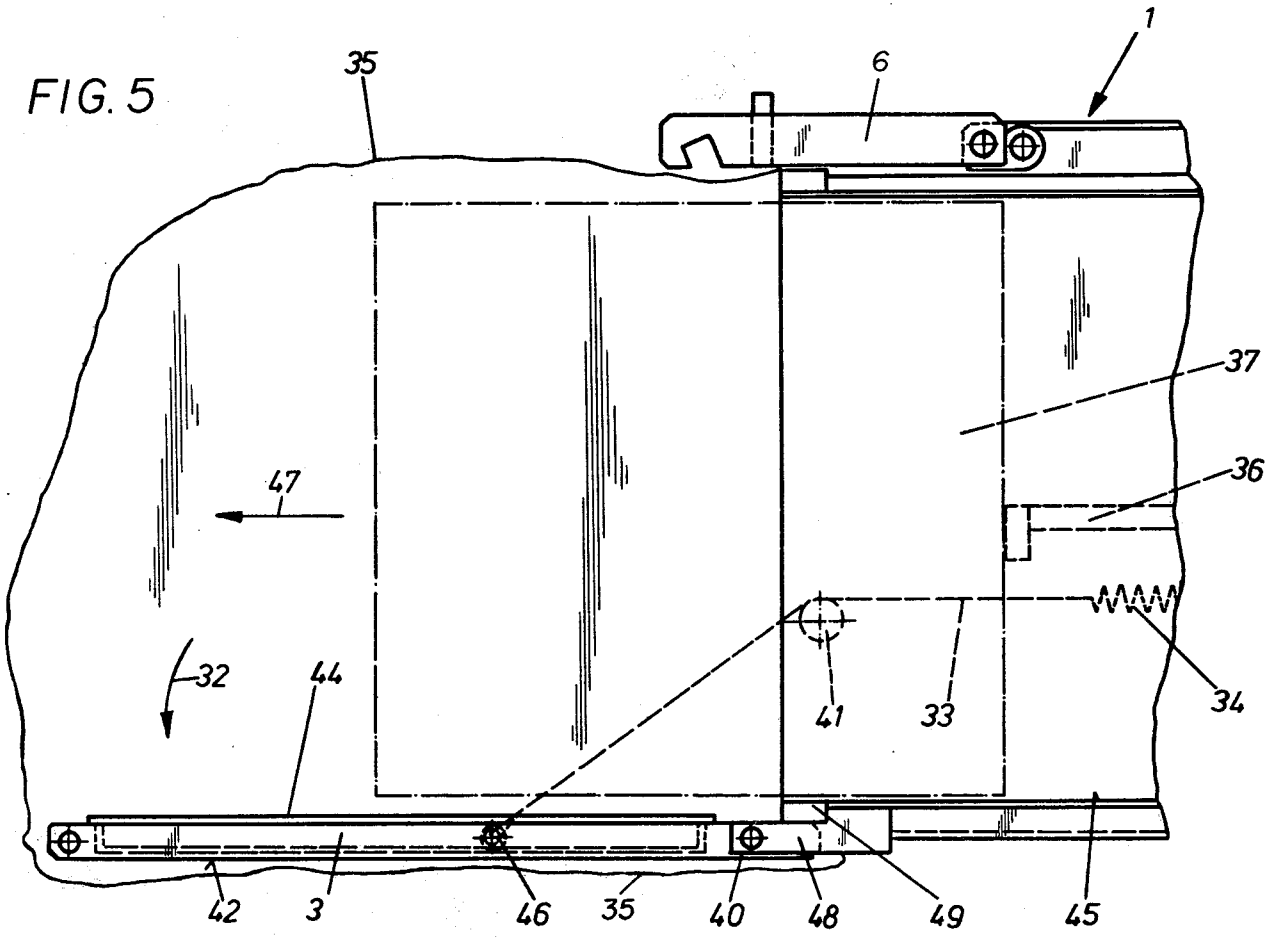
FIG. 5 illustrates a side view of the baling press with the bale being ejected into a sack mounted on the press door and press housing.

FIG. 5 shows one such embodiment. In FIG. 5 there is shown diagrammatically the side of a baling press housing 1. FIG. 5 shows the procedure for ejecting a finished pressed bale 37 forwardly with the assistance of an ejector 36.

The press door 3 was previously closed with the assistance of closure beams 6.

In the position shown, the press door 3 is open and forms with its inner door face 44 a sliding plane for the bale 37 to be ejected along the bottom face 45 of the baling press housing 1.

The pivot 40 of the door 3 is arranged on the front side of the baling press under the opening of the baling press so that the inner door face 44 always lies lower or at the same height as the bottom face 45 of the baling press so that the bale 37 can be pushed out without difficulty in the direction of the arrow 47.

The door 3 rests with its outer face on the setting up plane 42; rubber buffers or other distance pieces to support the door 3 in a horizontal position may be provided. It is possible for the position of the door to be fixed by only a cable fastened at one end on a fixing point 46 disposed on the door side a distance from the pivot 40 and the other cable end fastened to a coiled spring 34 connected to the housing of the baling press housing 1. The cable 33 is led over a guide roller 41 on the side wall of the press housing. As mentioned above, the pivot position of the press door 3 may therefore be limited in the direction of the arrow 32 by suitable stops on the bottom.

In the embodiment shown, the pivot position is designed so that the press door 3 is lengthened beyond its pivot 40 by a member 48 which in the open position of the press door 3, engages a stop 49 of the baling press housing 1. The stop 49 may be a rubber material or other elastic body, thereby allowing the door 3 to be inclined downwardly to enable the easy ejection of a bale 37. Likewise it is possible to connect parallel to the force storer (coiled spring 34) an impact damper in order to make the opening of the door still softer.

Because the door opens up in the direction of the arrow 32, it serves at the same time as a holder for a bag 35 which takes up the bale 37 ejected in the direction of the arrow 47.

The bag 35 is pushed over the opened press door 3 and fixed around the opening of the baling press housing 1. The bag 35 is held taut at least on its underside so that the bale 37 can be pushed without difficulty into the bag 35 by the ejector 36.

Figure 7:
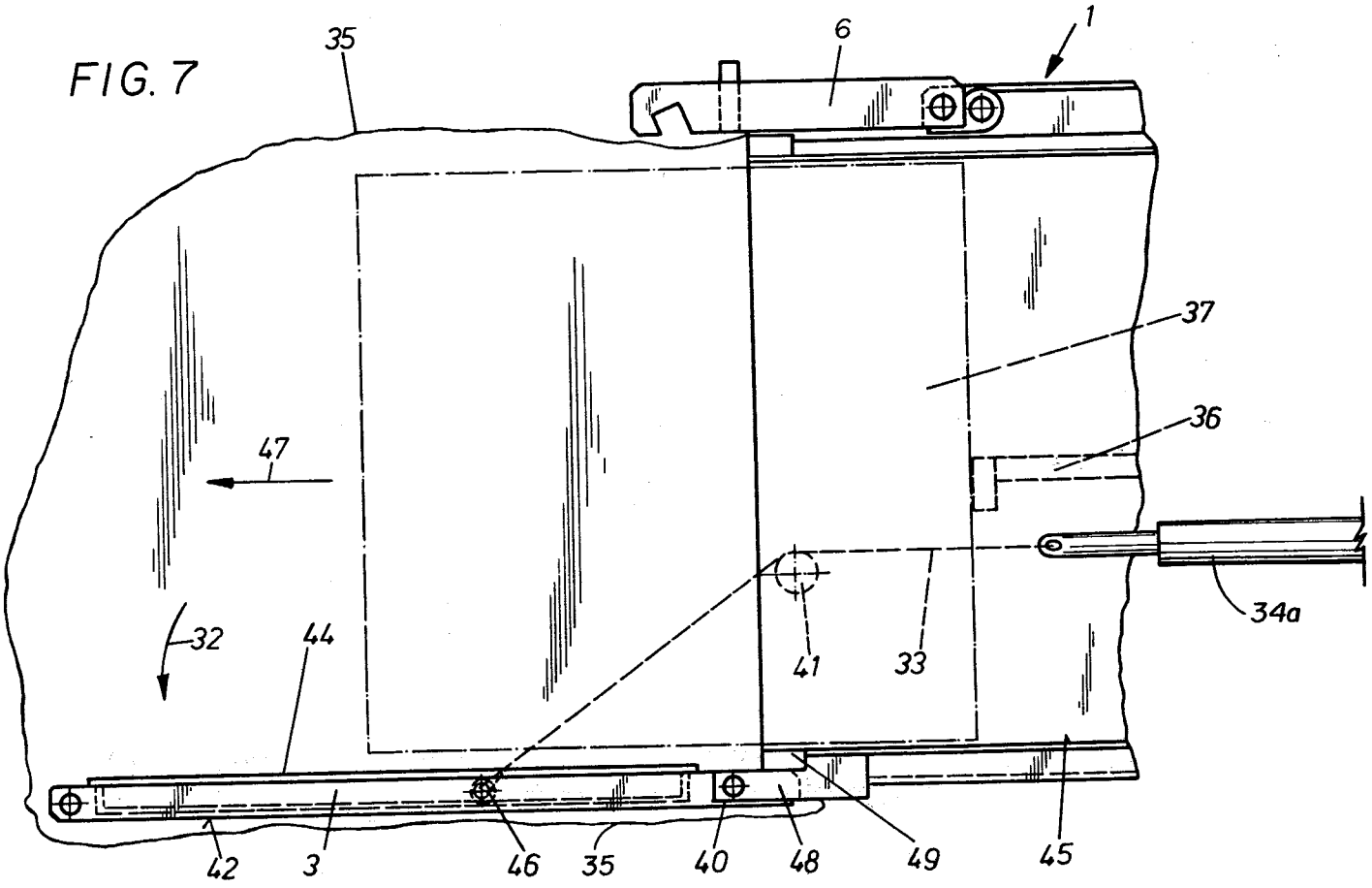
FIG. 7 illustrates the baling press of FIG. 5 with another embodiment of resilient means operatively attached to the door.

FIG. 7 shows an embodiment which is identical with FIG. 5 and using the same reference numerals, except that a pneumatic cylinder **34*a* replaces coil spring 34**.

INDUSTRIAL APPLICABILITY

The closure devices for the press door and filler slide may be utilized with baling presses.

What is claimed is:

1. A closure device for a baling press having one end enclosed by a press door, comprising a press door pivotably mounted at its lower end to said baling press, traverse bar means secured to the upper end of said door and for holding said door against said baling press, lever means fixably secured to an end of an eccentric member, the eccentric member having its opposite end rotatably coupled to the baling press, and a pivotable closure beam having one end rotatably connected to said lever means and the other end of the beam having a guide opening inclined at an angle to the vertical such that the guide opening is inclined opposite the direction of closure of said press door, the traverse bar means being received in the guide opening for holding said door against said baling press, whereby rotation of said lever means in a closure direction effects rotation of said eccentric member and a corresponding pivotable movement of the beam end rotatably connected to said lever such that the inclined guide opening is displaced towards said baling press to secure said door to the baling press.

2. The closure device in accordance with claim 1, wherein the end of said beam furthest from the guide opening in said beam is rotatably connected with a shaft nonrotatably connected to an end of said eccentric member, the other end of said eccentric lever nonrotatably connected to another shaft which is rotatably mounted in bearings operatively securely to said baling press.

3. The closure device in accordance with claim 1, further comprising an additional pivotable closure beam, eccentric member, and a rotatable shaft mounted on said baling press, said rotatable shaft connected to respective ends of said eccentric members each having its opposite end rotatably connected to an end of its associated pivotable closure beam.

4. The closure device in accordance with claim 3, further comprising common grip means operatively secured to each of said pivotable closure beams and which can be utilized to disengage said beams from said traverse bar after rotation of said lever means in a disengagement direction.

5. The closure device in accordance with claim 1, wherein said lever means is fixedly secured to an end of said eccentric member by means of a shaft providing the rotatable connection with the one end of said closure beam.

6.

The closure device in accordance with claim 1, further comprising a filler slide closure device in combination with said baling press closure device, the filler slide closure device comprising a filler slide door pivotably mounted on a side of said baling press, an angled lever pivotably mounted on said filler slide door, a closure bolt operatively connected to one end of said angled lever, a filler slide bore having said closure bolt slideably mounted therein, resilient means disposed in said bore, and bolt receiving means disposed at the adjacent baling press housing for receiving said closure bolt, whereby rotation of said angled lever in an opening direction retracts said closure bolt from said receiving means and against the opposing force of said resilient means to effect an opening of said filler slide door.

7. The filler slide closure device in accordance with claim 6, wherein an end of said closure bolt received in said receiving means is chamfered whereby the shutting of said filler slide door automatically biases said closure bolt against said resilient means in a retraction direction so that the door closes and said bolt end is received by said closure bolt receiving means.

8. The filler slide closure device in accordance with claim 6, further comprising another angled lever, closure bolt, filler slide bore, and resilient means, all disposed on said filler slide door, second bolt receiving means, and common grip means connecting said angled levers for simultaneous operation of said closure bolts.

9. The closure device in accordance with claim 14, wherein the opposite end of said eccentric member is rotatably coupled to the baling press by means of a shaft nonrotatably connected to the eccentric member and rotatably mounted in bearing means secured to said baling press.

10. An apparatus for receiving bales ejected from a baling press in which a bale is compressed during the pressing process against a press door, comprising said press door being pivotably hinged on a lower side of the baling press, the pivot of the press door hinge being disposed parallel to the bottom interior surface of said baling press, an angled extension of said press door operatively connected to the bottom of said baling press, resilient rotational stop means disposed below said baling press for engagement with said angled extension upon opening of said press door, tow line means connected at one end to said press door at a point spaced apart from said pivot of the press door and the other end of said tow line means connected to resilient means tensioned on opening of the press door and relieved on closing of the press door, whereby opening of said press door effects extension of said resilient means so as to dampen the opening of said door and position said door in position suitable for receiving a bale ejected from said baling press.

11. The apparatus in accordance with claim 10, wherein said resilient means is a coiled spring.

12. The apparatus in accordance with claim 10, wherein said resilient means is a pneumatic cyclinder.

13. The apparatus in accordance with claim 10 further comprising enclosure means disposed about said door whereby said ejected bale slides upon said press door and compression of said resilient rotational stop means by said angled extention effects an incline of said press door to assist ejection of said bale into said enclosure means.

* * * * *